United States Patent [19]

Scheuter et al.

[11] Patent Number: 4,576,343

[45] Date of Patent: Mar. 18, 1986

[54] DOUBLE SUPPORTING ROLLER WINDING MACHINE

[75] Inventors: Siegbert Scheuter, Herbrechtingen; Friedrich Kuhn, Heidenheim, both of Fed. Rep. of Germany

[73] Assignee: J. M. Voith GmbH, Heidenheim, Fed. Rep. of Germany

[21] Appl. No.: 636,160

[22] Filed: Jul. 31, 1984

[30] Foreign Application Priority Data

Aug. 6, 1983 [DE] Fed. Rep. of Germany ..... 3328517

[51] Int. Cl.[4] ..... B65H 17/12; B65H 19/26

[52] U.S. Cl. ..... 242/66

[58] Field of Search ..... 242/66

[56] References Cited

U.S. PATENT DOCUMENTS

| | | | |
|---|---|---|---|
| 2,801,810 | 8/1957 | Kusel | 242/66 |
| 3,286,944 | 11/1966 | Kusel | 242/66 |
| 4,157,794 | 6/1979 | Brandauer et al. | 242/66 |
| 4,345,722 | 8/1982 | Kuhn | 242/66 X |
| 4,370,193 | 1/1983 | Knauthe | 242/66 X |

FOREIGN PATENT DOCUMENTS

| | | | |
|---|---|---|---|
| 1196463 | 7/1965 | Fed. Rep. of Germany . | |
| 2709684 | 9/1977 | Fed. Rep. of Germany | 242/66 |
| 2930474 | 10/1980 | Fed. Rep. of Germany . | |

*Primary Examiner*—Stuart S. Levy
*Assistant Examiner*—Lloyd D. Doigan
*Attorney, Agent, or Firm*—Albert L. Jeffers; Stephen T. Belsheim

[57] ABSTRACT

In a double supporting roller winding machine for winding material webs, especially paper or board webs, onto core tubes, a core tube insertion device is provided for inserting individual ones of the core tubes in a roller bed. The core tube insertion device is mounted on pivot levers, and has an insertion trough with an angular cross-section for the core tubes. The insertion trough is mounted pivotally on the levers and can be moved into a position in which one of the trough sides extends at least approximately horizontally. Thus, this one side can be used advantageously as a step from which to work and to enable the roller bed to be reached more easily.

6 Claims, 1 Drawing Figure

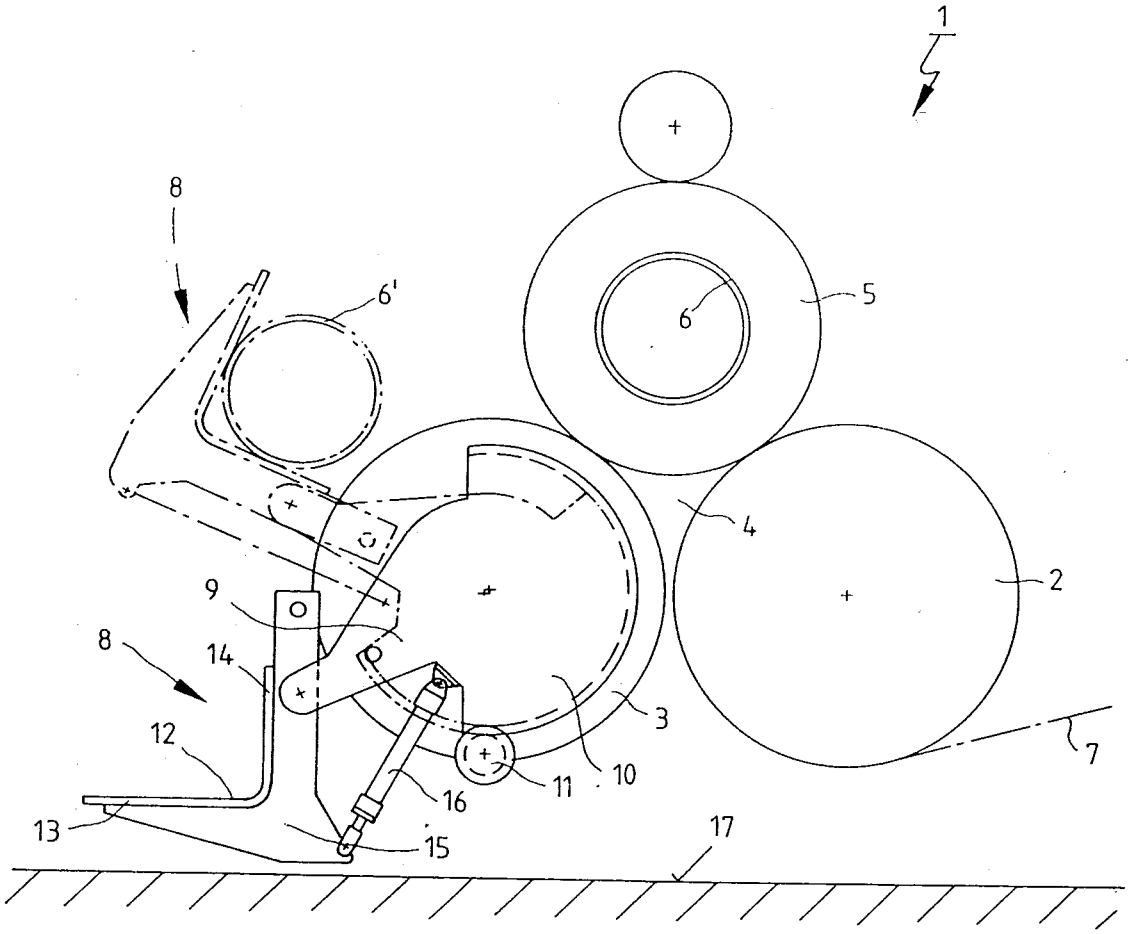
1
2
3
4
5
6
6'
7
8
8
9
10
11
12
13
14
15
16
17

DOUBLE SUPPORTING ROLLER WINDING MACHINE

BACKGROUND OF THE INVENTION

The invention relates to a double supporting roller winding machine of the type for winding material webs, such as paper or board webs, onto core tubes which are laid in the roller bed by a core tube insertion device mounted on pivot levers. This device, which extends along one supporting roller, has an insertion trough with an angular cross-section for the core tubes.

A previous machine of this type is disclosed in German Patent Specification No. 31 512 56.

Such machines have relatively large diameter supporting rollers and problems arise in reaching the roller bed in order to introduce the beginning of a new web or to stick a torn web back on an unfinished roll. Access to the roller bed is possible only over the supporting roller around which the web is not looped. In addition, the core tube insertion device extending along this supporting roller makes it more difficult to reach the roller bed.

One of the objects of the present invention is to make access to the roller bed easier in a double supporting roller winding machine of the type discussed above.

The present invention includes an insertion trough having a generally L-shaped cross-section formed by two sides angularly joined together. Thus, an operator can advantageously move about on the horizontally disposed side of the trough, and thus easily carry out work in the vicinity of the roller bed.

Further, the other generally vertically disposed side of the insertion trough separates the operator from the adjoining supporting roller.

BRIEF DESCRIPTION OF THE DRAWING

The above-mentioned and other features and objects of this invention and the manner of attaining them, will become more apparent and the invention itself will be better understood by reference to the following description of an embodiment of the invention taken in conjunction with the drawing which is a schematic front view of a preferred embodiment of the present invention.

DESCRIPTION OF A PREFERRED EMBODIMENT

Referring to the drawing, double supporting roller winding machine 1 includes two rotatably driven supporting rollers 2 and 3, which form therebetween roller bed 4 above their common central axial plane for supporting a winding roll 5. Winding roll 5 contains core tube 6 into which material web 7, which is fed into roller bed 4 from below and around supporting roller 2, is wound when supporting rollers 2 and 3 are rotated.

Winding machine 1 has a core tube insertion device 8 for inserting a new core tube 6' into roller bed 4 when a new winding cycle is to be initiated after the ejection of a fully wound roll 5 from roller bed 4. In the drawing, this function of device 8 is shown in broken lines.

Device 8 includes two pivot levers 9 disposed in the terminal regions of supporting roller 3. Each of these levers 9 is connected to a segment of a toothed wheel 10, which is mounted substantially coaxially with the axis of rotation of supporting roller 3. A pinion 11 engageable with toothed wheel segment 10 is used to drive core tube insertion device 8.

Core tube insertion device 8 extends along supporting roller 3 and includes an insertion trough 12 for a new core tube 6'. Insertion trough 12 has a generally L-shaped cross-section formed by two sides 13 and 14 angularly joined together. Insertion trough 12 is attached by sides 13 and 14 to angular supporting parts 15, which are pivotally mounted on levers 9. A servo motor 16 is arranged between each of the angularly supporting parts 15 of insertion trough 12 and pivot levers 9.

In addition to its function as a core tube insertor, device 8 can be used in another advantageous manner. As shown in the drawing in solid lines, after a catch (not shown) between pivot levers 9 and angular supporting parts 15 has been released, it is possible by means of servo motors 16 to pivot insertion trough 12 so that trough side 13 furthest from rollers 2,3 extends in a generally horizontal plane. Trough side 13 in this position extends at a distance from and above surface 17 on which machine 1 is disposed, and can be used by the operator as a step from which to work. Trough side 14, which is generally vertically disposed, separates the operator from rollers 2,3.. If required, insertion trough 12 can be raised further above surface 17 by means of pinion 11, so that winding roll 5 or roller bed 4 may be more easily reached.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A double supporting roller winding machine adapted for winding material webs, such as paper or board webs, onto core tubes disposed in a roller bed by a core tube insertion device, said core tube insertion device being mounted on pivot levers and extending along one of said supporting rollers and having an insertion trough with an angular cross-section, characterized in that said one supporting roller along which said core tube insertion device extends is not looped by the web, and said insertion trough is mounted pivotally between said insertion trough and said pivot levers so that said insertion trough is operable in a selected one of an insertion mode and an access mode, when in the insertio mode said insertion trough is movable to insert a new core tube and when in the access mode said insertion trough is swivelled relative to said levers so as to be selectively moveable to any one of a plurality of vertical positions wherein one of the sides of said trough is continually maintained in a generally horizontal disposition.

2. The winding machine of claim 1 wherein said one side of said insertion trough which is furthest from said rollers can be pivoted into the horizontal.

3. The winding machine of claim 1 wherein at least one servo motor is operatively arranged between said insertion trough and said pivot levers.

4. A double supporting roller winding machine adapted for winding material webs, such as paper or board webs, onto core tubes, comprising:

a pair of supporting rollers defining therebetween a roller bed, and a core tube insertion device adapted for placing the core tubes in said roller bed, said core tube insertion device being pivotally mounted on at least one pivot lever and longitudinally extending along one of said supporting rollers not looped by the web, said core tube insertion device further including an insertion trough having a generally angularly shaped transverse cross-section formed by two sides angularly joined together, said insertion trough being pivotally mounted on said at least one pivot lever and at least one motor means operatively arranged between said insertion trough and said pivot lever so that said insertion trough is operable in a selected one of an insertion mode and an access mode, when in the insertion mode said insertion trough is movable to insert a new core tube and when in the access mode said insertion trough is swivelled relative to said lever so as to be selectively movable to any one of a plurality of vertical positions wherein one of the sides of said trough is continually maintained in a generally horizontal disposition.

5. The winding machine of claim 4 wherein said one side of said insertion trough furthest from said rollers is pivotal into the horizontal.

6. The winding machine of claim 4 wherein at least one motor means is operatively arranged between said insertion trough and said pivot lever.

* * * * *

UNITED STATES PATENT AND TRADEMARK OFFICE

CERTIFICATE OF CORRECTION

PATENT NO. : 4,576,343

DATED : March 18, 1986

INVENTOR(S) : Siegbert Scheuter

It is certified that error appears in the above-identified patent and that said Letters Patent is hereby corrected as shown below:

Col. 1, line 54, change "into" first occurrence, to --onto--.

Col. 2, line 22, delete "."

Claim 1, Col. 2, line 48, change "insertio" to ---insertion--.

Signed and Sealed this

*Tenth* Day of *June 1986*

[SEAL]

*Attest:*

DONALD J. QUIGG

*Attesting Officer*

*Commissioner of Patents and Trademarks*